United States Patent [19]

Bledsoe

[11] Patent Number: 4,753,217

[45] Date of Patent: Jun. 28, 1988

[54] CHAMBERED GAS FIRED CONVECTION HEATER

[76] Inventor: Lloyd S. Bledsoe, 5732 Woodglen La., Paradise, Calif. 95969

[21] Appl. No.: 42,978

[22] Filed: Apr. 27, 1987

[51] Int. Cl.[4] ..... F24H 3/00

[52] U.S. Cl. ..... 126/116 R; 126/71; 126/85 R; 126/91 R; 126/106; 237/53

[58] Field of Search ..... 126/116 R, 116 B, 106, 126/114, 65, 66, 85 R, 71, 144; 237/50, 53, 70

[56] References Cited

U.S. PATENT DOCUMENTS

| | | | |
|---|---|---|---|
| 1,222,487 | 4/1917 | Swihart | 126/85 R |
| 1,288,516 | 12/1918 | Cole | 126/91 |
| 2,221,647 | 11/1940 | Mooney | 126/91 R |
| 2,612,890 | 10/1952 | Harsh | 126/106 X |
| 2,727,506 | 12/1955 | Turner | 126/71 X |
| 2,950,713 | 8/1960 | Sterick | 126/85 R |
| 3,439,666 | 4/1969 | Schuch | 126/71 X |
| 3,623,458 | 11/1971 | Block | 126/85 R |

*Primary Examiner*—Larry Jones

[57] ABSTRACT

The invention provides a compartmented gas fired heater in a cabinet-type outer stove casing. The outer stove casing has a downwardly positioned covered bottom with adjustable legs at four corners and an upwardly positioned opened top edge. A heat chamber insert having a covered bottom and an opened top is fitted inside the outer stove casing and retained so a corridor exists between all wall surfaces and the two bottoms. The top of the two sections are covered over the corridor area by a framing cover leaving the top of the heat chamber insert open as a hot air outlet. A caged outlet cover fits over the hot air outlet. Cool air is passed into the heat chamber insert through an air inlet casing. When a controlled gas burner is fired in the corridor below the bottom of the heat insert chamber, heat spirals up the corridors, is conducted through the outer stove casing and through the heat chamber insert walls and convected up through the top hot air outlet.

7 Claims, 2 Drawing Sheets

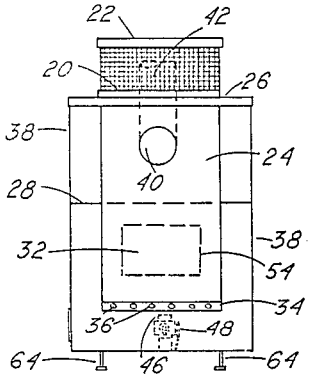
Fig. 1. A.
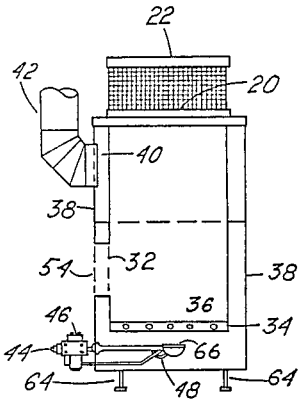
Fig. 1. B.
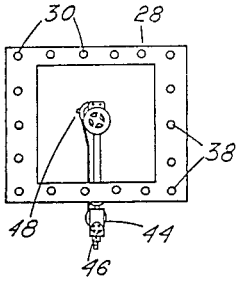
Fig. 1. C.
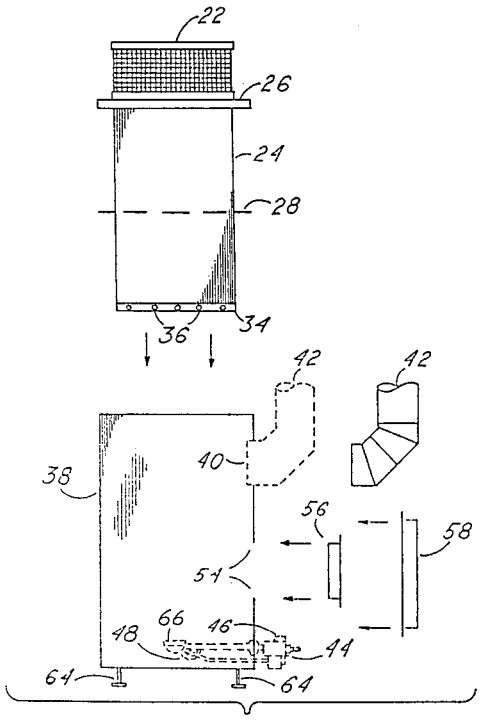
Fig. 2.
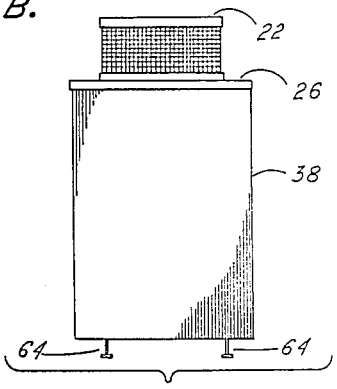
Fig. 3.
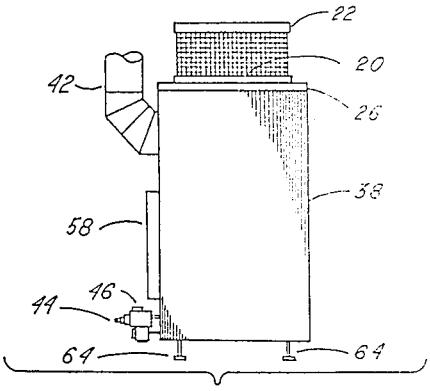
Fig. 4.

CHAMBERED GAS FIRED CONVECTION HEATER

BACKGROUND OF THE INVENTION

1. Field of the Invention

This invention relates to chambered convection heaters. The present invention is particularly directed towards chambered convection heaters using gas elements as heat supplying fixtures and natural or bottled gas as the heating fuel. The developing art for this concept is normally seen in referenced issued patents in the Group Art Unit included in the classes and subclasses of 126/116R and 70. Some of the older furnaces and heaters are chambered but the important central chamber is heated internally and usually extended through the housing to the gas vent. This looses the efficiency produced in the present invention by externally heating the walls of a heat chamber insert.

2. Description of the Prior Art

In state-of-the-art patents examined, the following were seen as the most pertinent to my heater design:

An "Apparatus for obtaining Heat from Gas" described in U.S. Pat. No. 236,869, issued to Allen and Harris on Jan. 25, 1881, shows a gas heated stove with internal compartments. As illustrated, the stove is primarily a water heater and oven included in a simple radiant heater with an unvented stove cabinet. It is to be noted that the present invention is a combination radiant and convection heater. A patent issued to C. Schellhammer for a "Heater" on May 2, 1893, U.S. Pat. No. 496,750, shows a heating furnace with a central chamber internally heated which is gas fueled and fired by a pilot light. In U.S. Pat. No. 952,194, dated Mar. 15, 1910, J. L. Henry disclosed a hydrocarbon burning heater in a two-sectional structure. More sophasticated structures are seen in the hot air furnaces of D. J. Luty, Dec. 8, 1936, U.S. Pat. No. 2,063,321, and of F. A. Warren et al, U.S. Pat. No. 2,227,773, dated Jan. 7, 1941. A cabinet-type heater is shown by E. G. Wilson in his patent dated Apr. 29, 1952, U.S. Pat. No. 2,594,834. Forced air heaters are described by S. D. Tate, U.S. Pat. No. 2,627,265, issued Feb. 3, 1953, and by J. L. Heiman, U.S. Pat. No. 3,171,400, dated Mar. 2, 1965. A chambered space heater with blower is illustrated in the Hensick et al patent dated Jan. 12, 1982, U.S. Pat. No. 4,309,978.

The simple put-together structure of my invention, which reduces required parts and uncomplicates the mechanics of past-art devices, is an impovement over the disclosures seen in the past-art patents for a small cabinet type heater.

SUMMARY OF THE INVENTION

In practicing my invention, I provide convection type heating device. It is specifically designed to heat air passing through an internal corridor. A gas burner positioned below a heating pan is in an opened position to allow passage upward of the heated air from below the stove chamber. The heat spirals upward between the outer cabinet wall and an inner compartment wall to a vent positioned in the upper rear of the cabinet. Both the outer cabinet wall and the inner compartment wall are heated. The outer cabnet wall radiates heated air into the room. The inner compartment walls on being heated creates a draft pulling the cool air in through an air intake aperture opened in the lower chamber and extending through the lower section of the cabinet wall to the heating chamber. As air is heated in the heating chamber it rises and exits out through a screened venting hood in the top of the stove cabinet.

Therefore it is a primary object of my invention to provide a small cabinet-type gas fired stove structured to produce both a radiant and a convection heating effect.

Another object of my invention is to provide an efficient compartmented gas fired stove properly vented and housed for operating in modern living room areas, A still further object of the invention is to provide a compartmented cabinet-type stove with internal heat convection structure having heat retaining features and top venting capabilities.

Other objects and the many advantages of the present invention will become obvious by reading the specification and comparing the described numbered parts with similarly numbered parts shown on the drawings.

BRIEF DESCRIPTION OF THE DRAWINGS

In the drawings:

FIG. 1 shows the chambered gas fired convection heater constituting the present invention in opened line drawings illustrating internal fixtures in a frontal view at 1A, in a side view at 1B, and in a top plan view at 1C, illustrating the insert heat collar and gas fixture.

FIG. 2 shows the stove cabinet with the insert positioned above it ready for installation with the vent pipe position shown at the back of the stove and the air intake frames adjacent below the vent pipe.

FIG. 3 illustrates the cabinet of the stove with the caged vent cover, the insert cover, and the adjustable legs.

FIG. 4 is a side view of the assembled stove reversed from FIG. 2.

STOVE NUMBERED PARTS

Figures 5, 6:
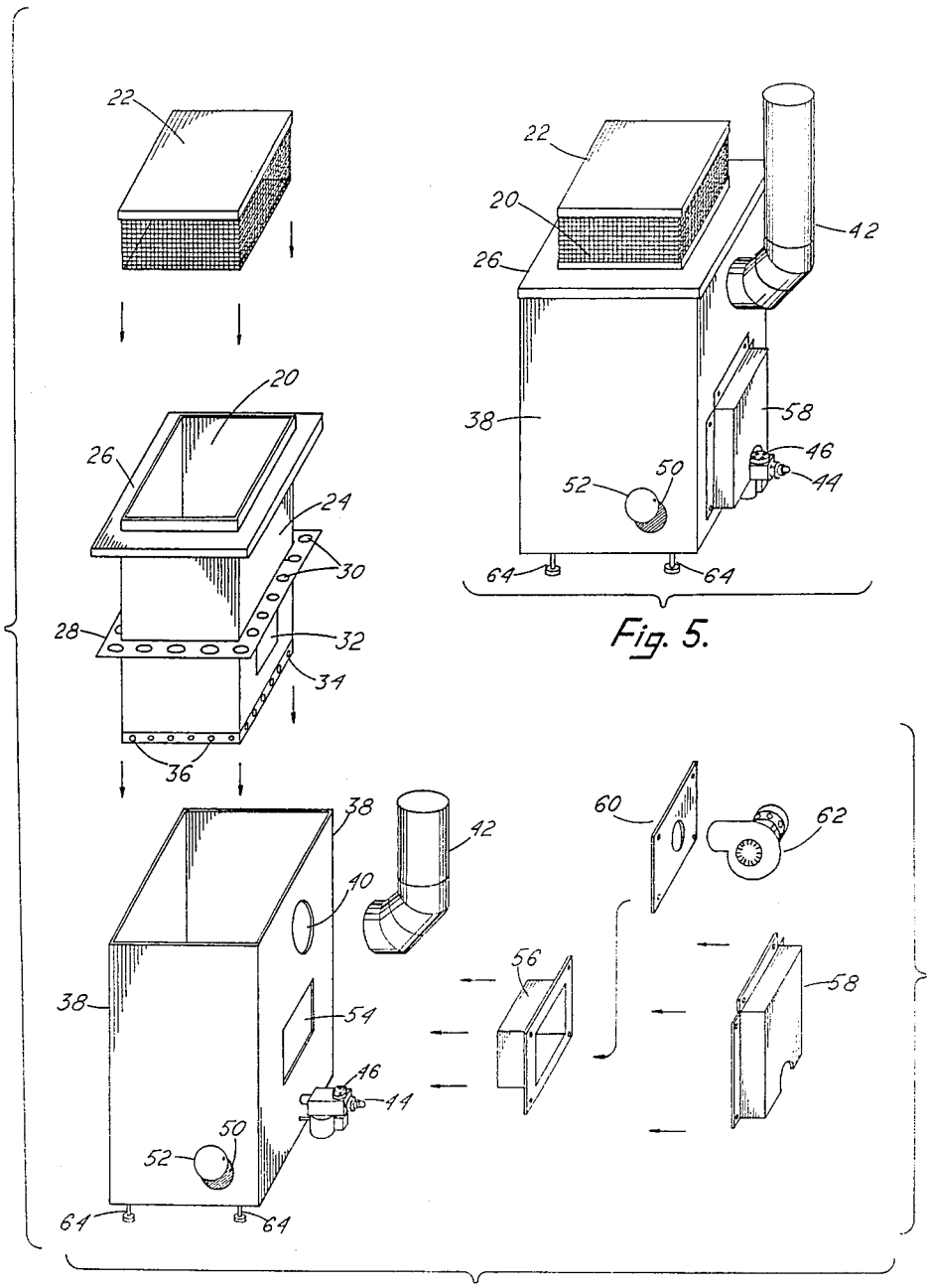
FIG. 5 shows the assembled stove in a perspective view.
FIG. 6 is an exploded view of the stove cabinet, the insert section, the caged outlet cover, the vent pipe, the air vent frame; and an auxiliary plate and blower with all the fixtures aligned for installation.

20 hot air outlet
22 caged outlet cover
24 heat chamber insert
26 insert cover
28 insert heat collar
30 heat collar flow apertures
32 insert cold air inlet opening
34 insert one inch framed base air space
36 base heat flow apertures
38 outer stove casing
40 gas vent aperture
42 gas vent flu pipe
44 gas valve
46 thermostate
48 piolet light
50 piolet light access opening
52 piolet light access cover
54 casing inlet air opening
56 air inlet duct fixture
58 air inlet passage cover
60 optional air inlet passage cover
62 optional electric blower
64 adjustable stove legs

DESCRIPTION OF THE PREFERRED EMBODIMENT

Referring now to the drawings at FIG. 1A, 1B, and 1C where the stove assemblage constituting the present invention is illustrated. For heat convection purposes, hot air outlet 20 is an opening in the top of insert cover 26. Caged outlet cover 22 fits hot air outlet 20 as a distribution vent. Heat chamber insert 24 to which inset cover 26 is affixed upwardly is centrally encircled by insert heat collar 28. Insert cold air inlet opening 32 is cut through one wall of heat chamber insert 24 below inset heat collar 28. An aligned similar opening, casing inlet air opening 54, is cut in outer stove casing 38. Application of heated air to the base or walls of heat chamber insert 24 produces heat convection upwardly within the chamber.

The disassembled parts are best seen in FIG. 6 of the drawings. Insert recessed base frame 34 aligned with base heat flow apertures 36 is the bottom section of heat chamber insert 24 as illustrated. Heat chamber insert 24 is lowered into outer stove casing 38 with insert heat cover 26 resting on and encasing the upper edge of outer stove casing 38. Insert heat collar 28 centrally positions heat chamber insert 24 in outer stove casing 38. Heat collar flow apertures 30 open an upward passageway for air heated by gas burner 66 positioned below insert recessed base frame 34. Base heat flow apertures 36 pass the heated air from below insert recessed base frame 34 into the corridor between the walls of heat chamber insert 24 and outer stove casing 38. Heat from the heated air in the corridor warms the walls of heat chamber insert 24 causing air supplied therein though insert cold air inlet opening 32 to move upwards by convection and heated air is dispurse through caged outlet cover 22. Warm air is radiated out into the room through the heating of outer stove casing 38, and the illustrated double wall arrangement contains the gaseous air and carbons in the corridor for discharge through gas vent aperture 40 and out gas vent flu pipe 42. Gas burner 66 is supplied by gas valve 44 and controlled by thermostate 46. Pilot light 48 activates gas burner 66 and is accessed for service through pilot light access opening 50 covered by hinged pilot access cover 52. Air inlet duct fixture 56 fits through outer stove casing 38 and through the insert cold air inlet opening 32 as a shaft allowing outside air to pass through the two wall and into heat chamber insert 24. Air inlet passage cover 58, opened at the bottom, is a protective and decorative shielding cover for air inlet duct fixture 56. Optional electric blower 62 can be installed by replacing air inlet passage cover 58 with optional air inlet passage cover 60. For leveling, outer stove casing 38 is fitted with adjustable stove legs 64.

Although I have described my invention with considerable details in the foregoing specification, it is to be understood that certain modifications in the design and structure may be practiced which do not exceed the intended scope of the appended claims.

What is claimed is:

1. A chambered gas-fired convection heater with elements thereof comprising:

an outer stove casing;

said outer stove casing being an external housing for said heater configured rectangularly in a box-like structure having attached longer edges of four rectangular panels formed into two similarly widened panels as a front panel and a back panel and two similarly narrowed panels as opposite sides thereof, said box-like structure having a closed covering at one end, said external housing designed for vertical positioning lengthwise with said covered end downwardly as a bottom therefor, said opened end and the edge thereof upwardly included; said back panel apertured adjacent said opened upper edge as a gas vent sized for attachment of an extended flue pipe, a squared opening for an air inlet fixture cut in a downwardly position therein, and a gas line aperture opened near the bottom thereof; there being a pilot light access opening covered by a hinged door adjacently aligned to said gas line aperture in said side panel; there being downwardly extending adjustable stove legs fitted in said bottom at each corner of said outer stove casing;

a heat chamber insert;

said heat chamber insert being a single piece box-like rectangular structure of four adjacent panels affixed lengthwise and of similar configuration to the panels of said outer stove casing with one end thereof surfaced as a closure, the longer sides for vertical positioning with said surfaced end downwardly as a closed bottom therefor, the opened end and edge thereof upwardly inclined, and said heat chamber insert sized for drop placement inside said outer stove casing in vertical alignment therewith to a depth so said opened end edge aligns horizontally protruded somewhat above with said outer stove casing opened end edge and centered so measured and retained corridor space exists between the outer facings of said rectangular wall panels of said heat chamber insert and the inner facings of said rectangular wall panels of said outer stove casing, said corridor spacing included in the positioning of said bottom of said heat chamber insert to said bottom of said outer stove casing; said heat chamber insert, a wider said panel thereof, opened therethrough rectangularly being sized and positioned for alignment with said air inlet duct opening in said outer stove casing;

an insert heat collar;

said insert heat collar being a horizontally disposed platform having an alignment of air passage apertures cut therethrough and structured as a support member affixed centrally to said outer facings of said rectangular wall panels of said heat chamber insert; said insert heat collar sized to fit and retain said corridor at said measured space vertically;

an insert cover;

said insert cover structured as an upper support frame and covering sized to fit over said corridor space between said heat chamber insert outer-faced panel wall surfaces leaving a short upward protrusion of said edge thereof and said outer stove casing inner-faced panel wall surfaces and said exposed edge thereof, said insert cover affixed to and framing said opened upper end of said heat chamber insert edge as a collar and having a downwardly angled lip to cap over said outer stove casing upper edge, said insert cover providing secondary vertical corridor maintainance support and retained horizontal positioning of said corridor between said bottom of said heat chamber insert and said bottom of said outer stove casing;

a caged outlet cover;

said caged outlet cover structured box-like with a solid cap-type top, opened cross-wired vented side walls, and a base frame sized to fit said opened upper end of said heat insert chamber and encompas said panel protrusion above and down to said insert cover;

an insert recessed base frame;

said insert recessed base frame being an edging affixed to said downwardly positioned covered end bottom of said heat chamber insert as an extension thereto forming a heat retaining compartment positioned above a gas-fired burner affixed in said corridor below said insert recessed base frame; said frame cut with a plurality of heat flow release apertures and affixed to said insert heat chamber bottom as a downwardly extension of said side panels;

an air inlet duct fixture and coverings therefor;

Said air inlet duct fixture being a rectangularly configured four-walled box structure with the edges of one end framed outwardly at right angles and apertured for attachment, said air inlet duct fixture sized to fit through said casing inlet air opening and said insert cold air inlet opening as a walled passageway through said corridor area to provide a cool air intake into said heat chamber insert, there being coverings for said inlet duct fixture including an opened-bottom, framed panel cover and a flat panel cover with attachment apertures therein either useful for external covering of said air inlet duct fixture, said flat panel covering having means for attachment of auxiliary blower equipment.

2. The chambered gas-fired convection heater of claim 1 wherein said outer stove casing of rectangular configuration for lengthwise vertical positioning has all said panels thereof of equally width.

3. The chambered gas-fired convection heater of claim 1 wherein said heat chamber insert configured rectangularly for lengthwise vertical positioning has all said panels thereof of equal width.

4. The chambered gas-fired convection heater of claim 1 wherein said inlet duct fixture includes extensions thereof fitting air passage systems or wall passage ducts.

5. The chambered gas-fired convection heater of claim 1 wherein said caged outlet cover is structured with extended solid side walls and a vented top.

6. The chambered gas-fired convection heater of claim 1 wherein said assemblage of elements has a variety of cross sectional cooperative structure shapes including square, round, and oval in addition to said rectangular configuration.

7. The chambered gas-fired convection heater of claim 1 wherein said wall corridor size and said bottom corridor size varies according to application requirements and selected sizes used of said elements.

* * * * *